US005280144A

United States Patent [19]

Bolongeat-Mobleu et al.

[11] Patent Number: 5,280,144

[45] Date of Patent: Jan. 18, 1994

[54] HYBRID CIRCUIT BREAKER WITH AXIAL BLOWOUT COIL

[75] Inventors: Roger Bolongeat-Mobleu, Echirolles; Olivier Cardoletti, Grenoble; Peter Malkin, St. Nazaire les Eymes, all of France

[73] Assignee: Merlin Gerin, France

[21] Appl. No.: 961,366

[22] Filed: Oct. 15, 1992

[30] Foreign Application Priority Data

Oct. 17, 1991 [FR] France ..... 9113063

[51] Int. Cl.[5] ..... H01H 33/64; H01H 33/66; H01H 33/12

[52] U.S. Cl. ..... 200/148 R; 200/144 B; 200/147 R

[58] Field of Search ..... 200/144 B, 145, 146 R, 200/147 R, 148 R, 148 B, 146 A, 146 AA

[56] References Cited

U.S. PATENT DOCUMENTS

| | | | |
|---|---|---|---|
| 4,661,665 | 4/1987 | Carroll et al. | 200/144 B |
| 4,661,666 | 4/1987 | Sakuma et al. | 200/144 B |
| 4,707,577 | 11/1987 | Tamaki et al. | 200/144 B |
| 4,975,552 | 12/1990 | Niegl et al. | 200/144 B |
| 5,155,315 | 10/1992 | Malkin et al. | 200/148 R |

FOREIGN PATENT DOCUMENTS

| | | |
|---|---|---|
| 204262 | 12/1986 | European Pat. Off. . |
| 433184 | 6/1991 | European Pat. Off. . |
| 8717511 | 2/1989 | Fed. Rep. of Germany . |
| 8904071 | 9/1990 | Fed. Rep. of Germany . |

*Primary Examiner*—J. R. Scott

*Attorney, Agent, or Firm*—Parkhurst, Wendel & Rossi

[57] ABSTRACT

A vacuum cartridge of a hybrid circuit breaker comprises an end-plate having a groove for housing an annular coil external to the cartridge and electrically connected in series with the contacts of the cartridge. The coil is located facing the arcing contacts and is rigidly held by the groove.

7 Claims, 3 Drawing Sheets

HYBRID CIRCUIT BREAKER WITH AXIAL BLOWOUT COIL

BACKGROUND OF THE INVENTION

The invention relates to a medium voltage electrical circuit breaker comprising a sealed enclosure filled with a high dielectric strength gas such as sulphur hexafluoride, a pair of main contacts located in said enclosure, a vacuum cartridge having a cylindrical housing sealed off by two end-plates. The vacuum cartridge is located in said enclosure and contains a pair of aligned arcing contacts which are electrically connected in parallel to said main contacts. The circuit breaker includes an operating mechanism to open the arcing contacts after the main contacts open and to close them before the main contacts close and a coil for producing an axial magnetic field in the formation zone of an arc, the magnetic field being drawn inside the cartridge when separation of the arcing contacts takes place.

A state-of-the-art circuit breaker (U.S. Pat. No. 5,155,315) of the kind mentioned, comprises an axial blowout coil incorporated in the cartridge. The coil is formed by notches arranged in the end-plate of the cartridge. This part is delicate to manufacture and only a fraction of the current flows along the spiral trajectory constituting the coil. The spectrum of the magnetic field generated by the coil is not ideal and the need has arisen to achieve a simplified device with improved performance.

It has already been proposed to shape the contact parts in such a way as to impose a current trajectory in the form of a spiral, to generate the magnetic field in the arcing zone. This solution has the above-mentioned drawbacks of complex parts and of an imperfect magnetic field spectrum.

SUMMARY OF THE INVENTION

The electrical circuit breaker according to the invention is characterized in that a ring-shaped coil is located coaxially outside the vacuum cartridge and in the enclosure, while facing the gap separating the arcing contacts in the open position. Further, the diameter of the coil is less than the diameter of the housing and the end-plate adjacent to the coil comprises a groove in which the coil is disposed.

By placing the coil outside the vacuum cartridge, the parts internal to the latter are notably simplified, and the coil can be located facing the gap separating the contacts to generate an ideal magnetic field in the breaking zone. Vacuum cartridges having a coil external to the cartridge are already state-of-the-art, but the coil is always located around the insulating cylindrical housing. The presence of this coil around the insulating housing creates dielectric problems due to capacitive short-circuiting of the insulating housing by the coil. It is moreover very difficult to rigidly secure this coil which is subjected to large electromagnetic forces, the usual solution of coating having the drawback of limiting dissipation of the heat generated by the cartridge, and of increasing the dimensions of the latter.

By locating, according to the invention, the coil in a groove, arranged in the end-plate of the cartridge, the mechanical fixing and dielectric problems are overcome. The arcing contacts of the vacuum cartridge are located in the center of the coil and the field generated by the latter extends axially over the whole range of the contacts. The end-plate receiving the coil is advantageously the end-plate of the cartridge located on the stationary contact side and this end-plate, made of metallic or insulating material, is shaped in the form of a bell covering the stationary arcing contact with clearance. The cross section of the end-plate is naturally suited to the shape of the coil and the end-plate is open into the enclosure to enable the coil to be inserted therein. The whole assembly is cylindrical in shape and the external wall of the housing is extended up to the proximity of the end of the cartridge, where this external wall is joined to the insulating cylindrical housing of the cartridge. The insulation length of the vacuum cartridge is thus preserved, which produces a good dielectric withstand capability in sulphur hexafluoride. The coil advantageously comprises a single turn inserted with small clearance in the housing arranged in the end-plate, and having two ends respectively connected to the stationary arcing contacts and to the current input, i.e., to one of the main contacts. The ends of the turn contribute to the mechanical maintenance of the latter, and they extend parallel to the bell-shaped end-plate, in the direction of the axis of the cartridge to be mechanically secured to the stationary arcing contact. Electrical insulation of the end of the current input is achieved by simple insulating washers and the two ends of the coil are slightly staggered angularly to prevent any electrical contact.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
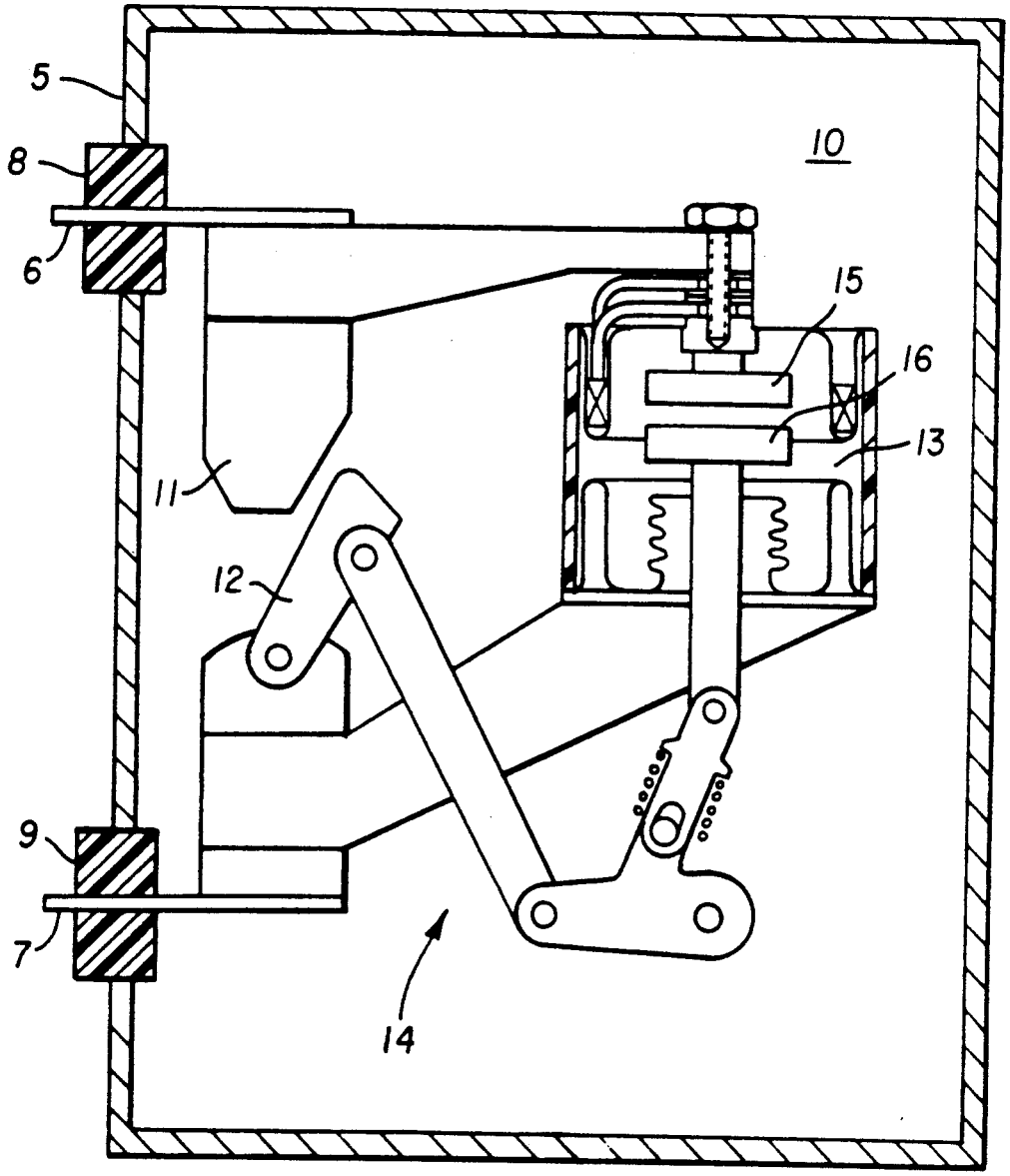
FIG. 1 is a schematic axial sectional view of a circuit breaker according to the invention.

FIG. 1, which corresponds appreciably to the figure of U.S. Pat. No. 5,155,315, illustrates the general structure of the hybrid circuit breaker comprising a sealed enclosure 10, comprising outer walls 5 filled with a high dielectric strength gas, such as sulphur hexafluoride. In the enclosure 10 there are housed main contacts 11,12 and a vacuum cartridge 13 electrically connected in parallel with the main contacts 11,12. Main contacts 11, 12 are electrically connected to terminals 6, 7, respectively. Terminals 6, 7 pass through bushings 8, 9, respectively. The assembly is operated by a mechanism 14 bringing about opening of the main contacts 11,12 before opening of the arcing contacts 15,16 of the vacuum cartridge 13. The above-mentioned U.S. patent should be referred to for further details on the structure and operation of this hybrid circuit breaker.

Figure 2:
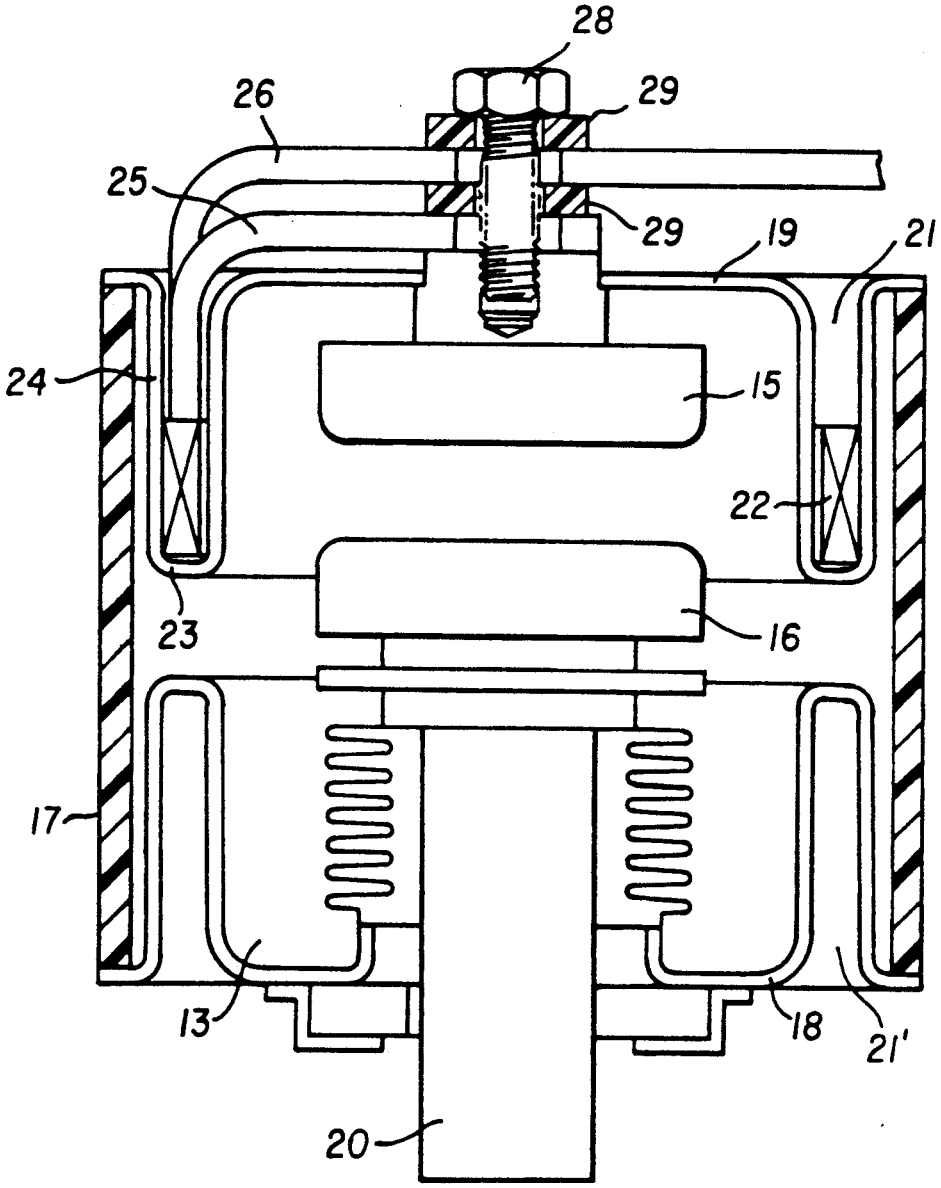
FIG. 2 is an enlarged scale view of the vacuum cartridge according to FIG. 1.
Figure 3:
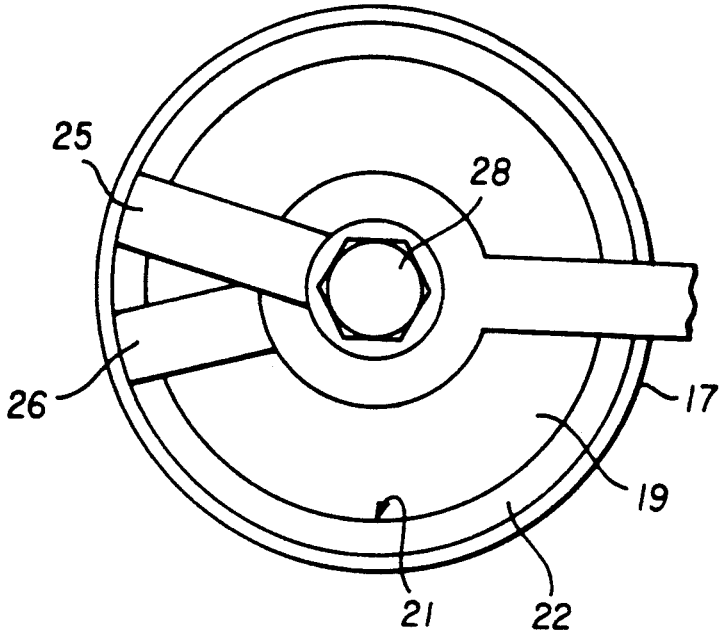
FIG. 3 is a schematic plan view of the vacuum cartridge according to FIG. 2.

Referring more particularly to FIG. 2, it can be seen that the vacuum cartridge 13 comprises a cylindrical housing 17 made of glass or ceramic material sealed off by two end-plates 18,19. Inside the cartridge 13 there are located stationary arcing contact 15 movable arcing contact 16 adjacent end plates 19 and 18, respectively.

Movable arcing contact 16 is supported by the operating rod 20 which passes tightly through the end-plate 18. The arcing contacts 15 and 16 are in the form of a disk made of high resistivity material. The end-plate 19 has an annular groove 21 extending up to the base of the gap separating the arcing contacts, 15,16 in the open position. End plate 18 may also include a groove 21'. Groove 21 open upwardly as shown in FIG. 2, and enables an annular coil 22 to be inserted to be positioned in the bottom of the groove 21 in such a way as to coaxially surround the gap separating the contacts 15,16. The arcing contacts 15,16 are arranged in the center of the coil 22, and it can easily be seen that the magnetic field generated by the current flowing through this coil 22 extends axially over the whole range of the arcing contacts 15,16. The coil 22 is inserted with a small clearance in the groove 21 which holds it mechanically. The end-plate 19 is in the shape of a bell covering the stationary arcing contact 15. Coil 22 is completely sealed off from the interior of vacuum cartridge 13 via external wall 24, bottom wall 23 and the remaining bell-shaped portion of the end plate 19. External wall 24 can be extended up to the level of the end-plate 19, in the manner represented in FIG. 2, and be joined at this place to the insulating cylindrical housing 17. The height of this external wall 24 can also be reduced if the dielectric withstand capability is sufficient. The assembly presents an axial symmetry and in a preferred embodiment, the end-plate 18 associated with the movable contact has a similar shape to that of the end-plate 19 associated with the stationary contact, the corresponding groove being in this case not used. In the example represented in FIG. 2, the end-plates 18,19 are metallic, and insulating is provided by the cylindrical housing 17. It is clear that the end-plates 18 and/or 19 can be insulating and contribute to or provide the dielectric capability of the cartridge 13 in the sulphur hexafluoride.

The coil 22 is a single turn of rectangular cross-section having two ends 25,26 appreciably parallel to the end-plate 19 so as to come out of the groove 21 and extend radially in the direction of the axis of the vacuum cartridge 13. The end 25 is pressed onto the stationary arcing contact 15 and has a hole 27 for the passage of a fixing screw 28. The other end 26 arranged as a current input conductor is superposed on the end 25, being insulated from the latter by insulating washers 29. The screw 28 passes through an enlarged orifice 30 to secure the two ends 25,26 to the stationary arcing contact 15 by screwing into a threaded orifice of the stationary arcing contact 15. The ends 25,26 thus contribute to holding the turn 22 in the groove 21 in a particularly simple manner. It can be seen that the current input via the end 26 flows through the turn 22 before reaching the stationary arcing contact 15, and thus generates the axial magnetic field in the separation zone of the arcing contacts 15,16.

Figure 4:
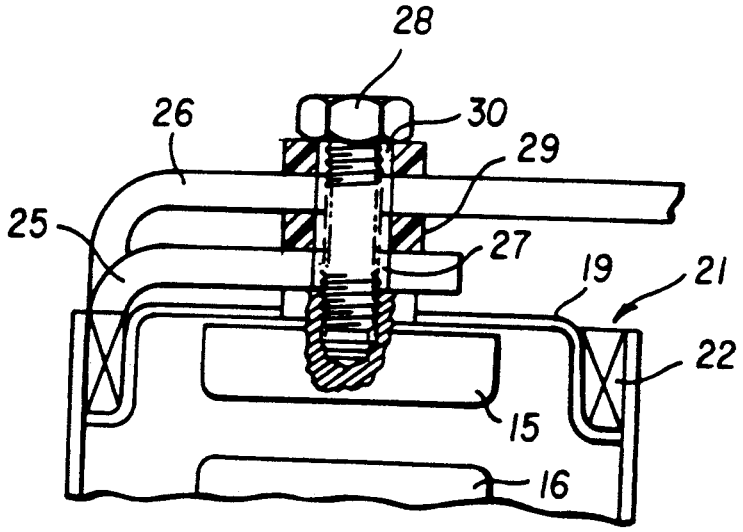
FIG. 4 is a partial view of FIG. 2, illustrating an alternative embodiment.

FIG. 4 illustrates an alternative embodiment wherein the coil 22 is located at the level of the end-plate 19 with a slightly upward displacement from the gap separating the arcing contacts 15,16 with respect to the previously described embodiment. The spectrum of the magnetic field generated by the coil 22 is no longer absolutely ideal as it presents a slight radial component, but the reduction of the depth of the groove 21 makes the end-plate 19 easier to manufacture. The advantages of mechanical binding of the coil 22 are on the other hand fully preserved.

The structure of the vacuum cartridge 13 is extremely simple.

The invention is naturally in no way limited to the embodiment more particularly described herein, and extends to any alternative embodiments remaining within the scope of the equivalences, notably to that wherein the coil comprises several turns, or to that wherein the coil is incorporated in a blanked off groove, either when manufactured or by a subsequent coating.

We claim:

1. A medium voltage circuit breaker comprising:

a sealed enclosure filed with a high dielectric strength gas;

a pair of main contacts disposed within said sealed enclosure;

a vacuum switch disposed within said sealed enclosure, said vacuum switch comprising a cylindrical housing comprised of an electrically insulating material, first and second end caps sealing off respective first and second opposite ends of the cylindrical housing, a pair of arcing contacts disposed within an internal volume defined by said cylindrical housing and said first and second end caps, said arcing contacts being electrically connected in parallel to said main contacts, each of said pairs of main and arcing contacts being operable between open and closed positions, said arcing contacts being separated from each other by a gap extending along a direction parallel to the longitudinal axial direction of the cylindrical housing in the open position, wherein said first end cap comprises an annular groove which has a diameter smaller than that of the cylindrical housing such that the annular groove is disposed radially inwardly from said cylindrical housing and longitudinally axially within said cylindrical housing, said annular groove being substantially coaxial with said cylindrical housing and extending toward said gap;

an operating mechanism mechanically connected to said main contacts and to said arcing contacts, said operating mechanism opening the arcing contacts after the main contacts open, and closing the arcing contacts before the main contacts close; and a ring-shaped coil disposed within said annular groove in said first end plate, said ring-shaped coil being sealed off from said internal volume of said vacuum switch by said first end plate.

2. The circuit breaker of claim 1, wherein the annular groove and ring-shaped coil extend longitudinally axially within said cylindrical housing to at least partially parallel said gap.

3. The circuit breaker of claim 1, wherein said arcing contacts comprise a stationary and a movable arcing contact.

4. The circuit breaker of claim 3, wherein said stationary arcing contact is disposed adjacent said first end plate.

5. The circuit breaker of claim 3, wherein said ring-shaped coil comprises a single loop having a first end and a second end spaced apart from each other, said first and second ends being respectively coupled to first and second connectors which extend out of said annular groove, said first connector being mechanically and electrically connected to stationary arcing contact.

6. The circuit breaker of claim 5, wherein the second connector is electrically connected to one of said main contacts and mechanically secured to the stationary arcing contact, said second connector being electrically insulated from the stationary arcing contact.

7. The circuit breaker of claim 6, wherein the first and second connectors are superposed on each other and comprise respective first and second holes for passage of a screw therethrough and into the stationary arcing contact, the first connector being in contact with said stationary arcing contact, the second connector being insulated from the first connector and said screw via insulating washers.

* * * * *